US009611718B1

(12) United States Patent
Bond et al.

(10) Patent No.: US 9,611,718 B1
(45) Date of Patent: Apr. 4, 2017

(54) CASING VALVE

(71) Applicant: Superior Energy Services, LLC, Harvey, LA (US)

(72) Inventors: Lesley O. Bond, Neosho, MO (US); Barry K. Holder, Montgomery, TX (US)

(73) Assignee: Superior Energy Services, LLC, Harvey, LA (US)

( * ) Notice: Subject to any disclaimer, the term of this patent is extended or adjusted under 35 U.S.C. 154(b) by 406 days.

(21) Appl. No.: 14/328,335

(22) Filed: Jul. 10, 2014

Related U.S. Application Data

(60) Provisional application No. 61/845,104, filed on Jul. 11, 2013, provisional application No. 61/970,775, filed on Mar. 26, 2014.

(51) Int. Cl.
*E21B 34/06* (2006.01)
*E21B 34/00* (2006.01)

(52) U.S. Cl.
CPC ..... *E21B 34/06* (2013.01); *E21B 34/00* (2013.01); *E21B 34/066* (2013.01); *E21B 2034/007* (2013.01)

(58) Field of Classification Search
CPC ..... E21B 34/06; E21B 34/066
See application file for complete search history.

(56) References Cited

U.S. PATENT DOCUMENTS 3,273,647 A * 9/1966 Briggs, Jr. ..... E21B 43/117 166/100
3,329,208 A * 7/1967 Voetter ..... E21B 49/06 137/67
3,664,415 A * 5/1972 Wray ..... E21B 49/081 166/162
4,798,244 A 1/1989 Trost
4,915,171 A * 4/1990 McMahan ..... E21B 23/006 166/184
5,343,963 A * 9/1994 Bouldin ..... E21B 23/00 166/65.1
5,558,153 A * 9/1996 Holcombe ..... E21B 23/04 166/373
5,762,142 A * 6/1998 Connell ..... E21B 17/06 137/614.2
5,984,006 A * 11/1999 Read ..... E21B 17/028 166/242.2
6,213,206 B1 * 4/2001 Bakke ..... E21B 23/04 166/242.7
6,237,683 B1 * 5/2001 Pringle ..... E21B 17/028 137/870
6,368,068 B1 * 4/2002 Corlew ..... E21B 43/121 417/120
6,408,946 B1 * 6/2002 Marshall ..... E21B 29/08 166/298

(Continued)

*Primary Examiner* — Shane Bomar
(74) *Attorney, Agent, or Firm* — Jones Walker LLP

(57) ABSTRACT

A casing valve including a tool housing defining an internal channel from a wellbore annulus. A valve allows selective communication between the internal channel and the wellbore annulus, where the valve has a sliding sleeve positioned externally to the tool housing. A first piston surface for opening the valve and a second piston surface for closing the valve are attached to the sleeve and a fluid supply valve directs fluid to the first and second piston surface. An electronic controller operates the fluid control valve to direct the fluid to the first and second control valve.

22 Claims, 6 Drawing Sheets

(56) References Cited

U.S. PATENT DOCUMENTS

| | | | | |
|---|---|---|---|---|
| 7,073,589 | B2 | 7/2006 | Tiernan et al. | |
| 7,096,954 | B2 | 8/2006 | Weng et al. | |
| 7,165,614 | B1 | 1/2007 | Bond | |
| 7,216,708 | B1 | 5/2007 | Bond et al. | |
| 7,331,398 | B2 * | 2/2008 | Dwivedi | E21B 34/10 137/628 |
| 7,681,645 | B2 | 3/2010 | McMillin et al. | |
| 8,044,820 | B2 | 10/2011 | Snider et al. | |
| 8,127,832 | B1 | 3/2012 | Bond | |
| 8,322,426 | B2 * | 12/2012 | Wright | E21B 34/063 166/317 |
| 8,397,741 | B2 * | 3/2013 | Bisset | E21B 34/06 137/68.13 |
| 8,839,871 | B2 * | 9/2014 | Wright | E21B 23/04 166/165 |
| 2009/0223663 | A1 | 9/2009 | Snider et al. | |
| 2010/0314562 | A1 * | 12/2010 | Bisset | E21B 34/06 251/12 |
| 2012/0251337 | A1 * | 10/2012 | Freeman | F04B 47/02 417/53 |

* cited by examiner

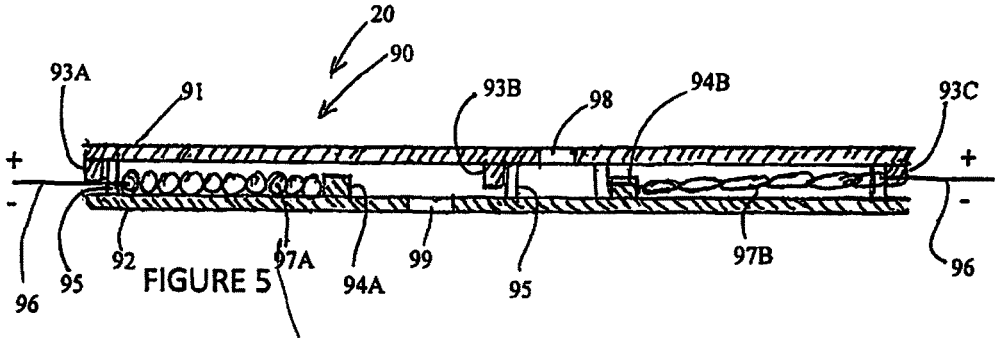
FIGURE 5
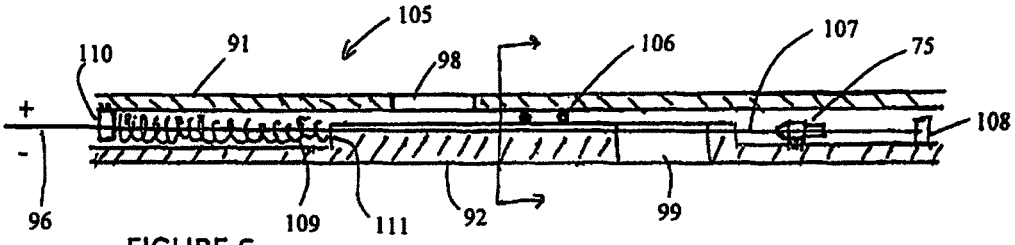
FIGURE 6
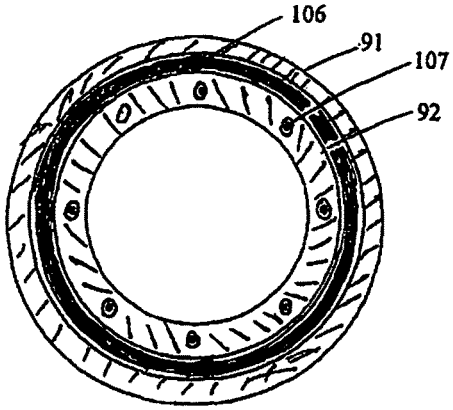
Section A-A

CASING VALVE

CROSS-REFERENCE TO RELATED APPLICATIONS

This application claims the benefit of U.S. Provisional Application No. 61/845,104, filed Jul. 11, 2013 and U.S. Provisional Application No. 61/970,775, filed Mar. 26, 2014, both of which are incorporated by reference herein in their entirety.

BACKGROUND OF THE INVENTION

This application generally relates to tools used "downhole" in oil and gas wells. More specifically, certain embodiments of the invention relate to valves, including but not limited to, casing valves used downhole. In many usages, the downhole tool is employed in a "completion" operation, i.e., the process of making a well ready for production, including well stimulation and treatment.

SUMMARY OF SELECTED EMBODIMENTS

One embodiment of the invention is a downhole tool comprising a main tool housing defining an internal channel from an external flow area. A valve allows for selective communication between the internal channel and the external flow areas and a valve actuation mechanism, including an electro-active material, provides at least one of an opening force or a closing force on the valve.

Another embodiment is a downhole completion tool comprising a main tool housing defining an internal channel from an external flow area and a valve allowing selective communication between the internal channel and the external flow areas. A valve actuation mechanism allows opening of the valve without intervention of a tethered activation tool and a propellant containing casing formed on the outside of the tool housing.

Another embodiment is a casing valve comprising a tool housing defining an internal channel from a wellbore annulus. A valve allows selective communication between the internal channel and the wellbore annulus, where the valve comprises a sliding sleeve positioned externally to the tool housing. A first piston surface for opening the valve and a second piston surface for closing the valve are attached to the sleeve and a fluid supply valve directs fluid to the first and second piston surface. An electronic controller operates the fluid control valve to direct the fluid to the first and second control valve.

Still further embodiments are described herein or will be apparent to those skilled in the art based upon the present disclosure.

BRIEF DESCRIPTION OF DRAWINGS

FIG. 5 illustrates an EAP activation mechanism for one embodiment of the downhole tool.

FIG. 6 illustrates an SMA activation mechanism for one embodiment of the downhole tool.

DETAILED DESCRIPTION OF SELECTED EMBODIMENTS

Figure 1:
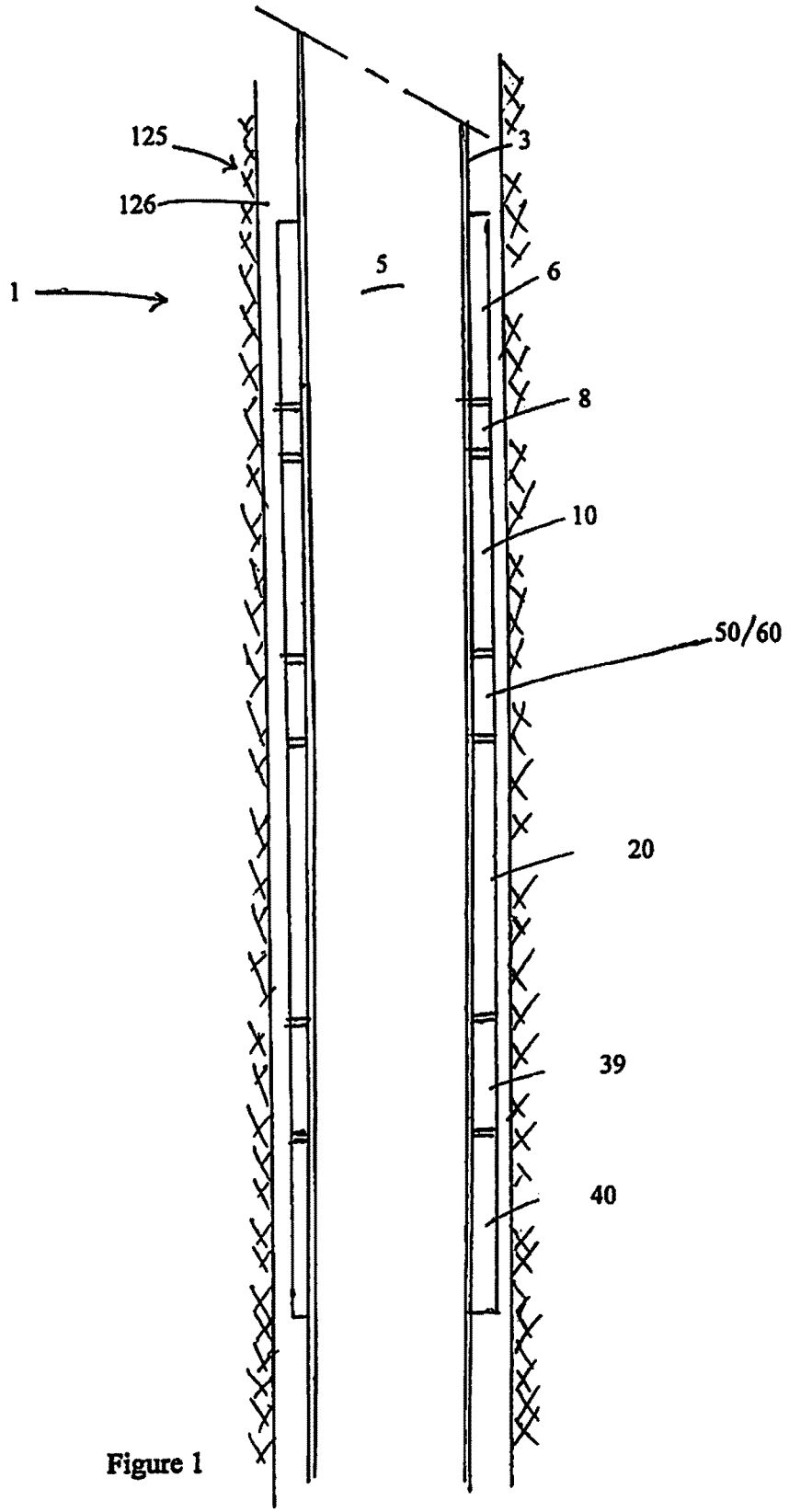
FIG. 1 is a schematic representation of one downhole tool of the present invention.
Figure 3:
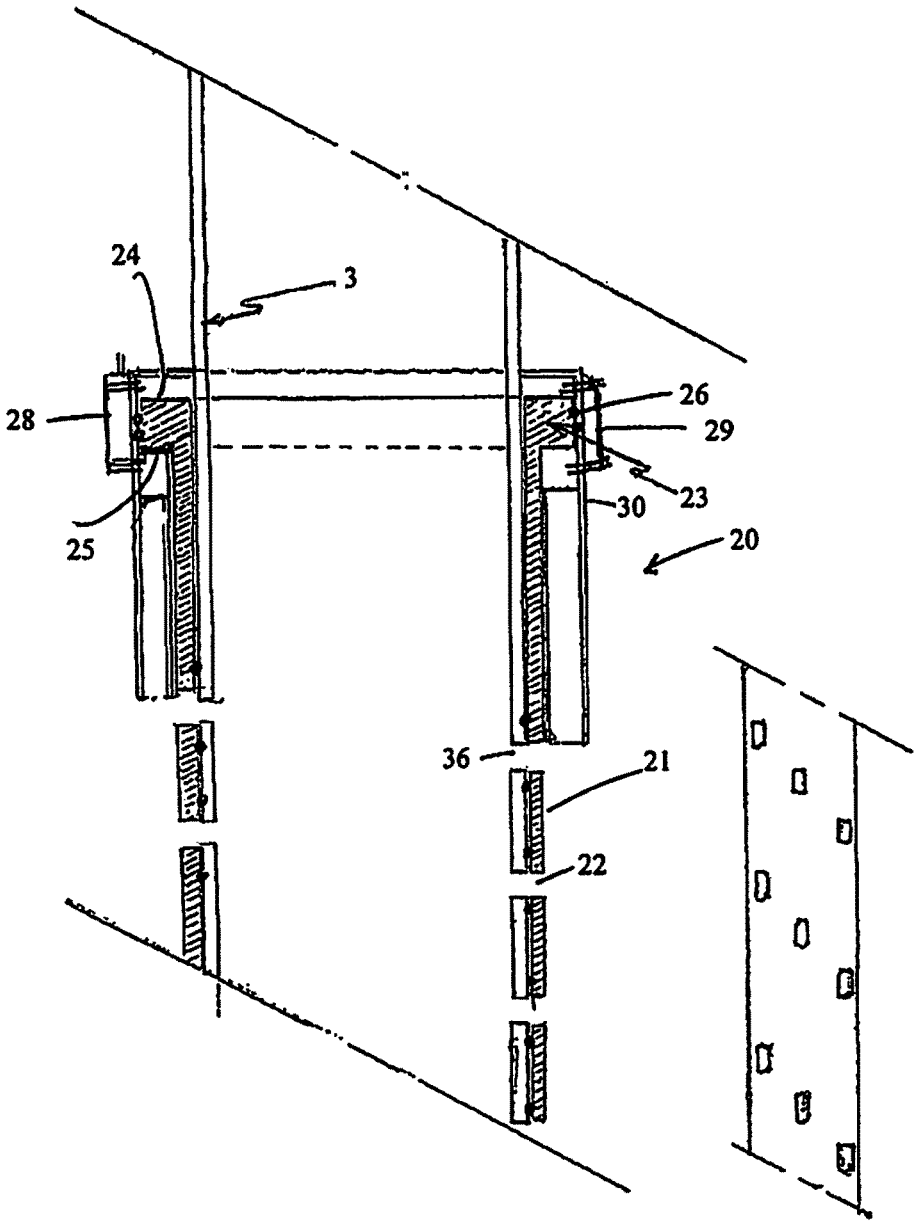
FIG. 3 illustrates one embodiment of a sleeve valve for the downhole tool.

FIG. 1 illustrates one embodiment of the present invention, downhole completion tool 1. In FIG. 1, the downhole tool is shown positioned in a wellbore 125 forming the wellbore annulus 126 between tool 1 and the wall of the wellbore. The annulus 126 as well as the central passage above and below tool 1 may be considered an external flow area to the central passage of tool 1. In many embodiments, the tool 1 is cemented within the wellbore, i.e., cement fills the annulus 126 around the tool. However, there may be other embodiments where the tool is not cemented into the wellbore. The tool 1 generally includes a tool housing 3 having a central passage or internal channel 5. In the example of FIG. 1, the tool housing 3 is formed by one or more sections of conventional well casing. For example, the casing 3 may be conventional production casing, allowing tool 1 to be readily made-up with a string of production casing conventionally used in completion operations. However, housing 3 is not limited to a particular casing type and could be formed from any number of tubular-shaped members. In the illustrated embodiment, a series of components are positioned on housing 3 as suggested schematically in FIG. 1. These components include battery housing 6, gas recharge material section 8, accumulator 10, control circuit housing 50, valve 20, spacer section 39, and propellant charge cartridge or section 40. Often, these components or their housings are circumferential outer bodies surrounding and attached to casing 3. However, there may be alternate embodiments where the components are not circumferential or could be internal to casing 3 (or mounted in the wall of casing 3). All such variations should be interpreted as the components being mounted "on" the casing or housing of the tool. The battery set may be from any conventional or future developed battery type suitable for use in the wellbore environment and capable of powering the functions described herein, with one example being lithium-ion polymer type batteries. In one embodiment illustrated in FIG. 3, valve 20 is an external sliding sleeve "casing valve" formed by the sliding sleeve 21 positioned on the exterior surface of casing 3. Sliding sleeve 21 will include a series of sleeve apertures or openings 22 which may move into and out of alignment with casing apertures 36 in order to open and close, respectively, the valve, thereby allowing selective communication between the internal channel 5 and the wellbore annulus 126. FIG. 3 suggests how seals will isolate sleeve apertures 22 from casing apertures 36 when the apertures are not aligned. Sliding sleeve 21 further includes a sleeve piston 23 having first (upper) piston surface 24 and second (lower) piston surface 25 which are isolated in upper valve housing 30 by seals 26. Generally, the length of upper valve housing need only be sufficient to allow the degree of piston/sleeve movement necessary to align and misalign apertures 22 and 36, for example about 3" to about 5" in many embodiments. It will be apparent from FIG. 3 that application of fluid pressure to upper piston surface 24 will tend to move sleeve apertures 22 into alignment with casing apertures 36, thereby "opening" valve 20. Similarly, application of fluid pressure to lower piston surface 25 will tend to move sleeve apertures 22 out of alignment with casing apertures 36, thereby "closing" valve 20. In the FIG. 3 embodiment, fluid pressure is alternatively directed to pistons surfaces 24 or 25 via the fluid supply valve 28, which may be for example, a solenoid activated valve capable of selectively directing pressurized fluid into the space in valve housing 30 above or below sleeve piston 23. Similarly, a solenoid activated pressure relief valve 29 may act to release pressurized fluid from the space above or below sleeve piston 23, i.e., releasing pressure on the piston face opposite to the piston face on which fluid supply valve 28 is increasing fluid pressure. In many embodiments, the valves 28 and 29 will be operated by a controller such as described below.

Figure 4:
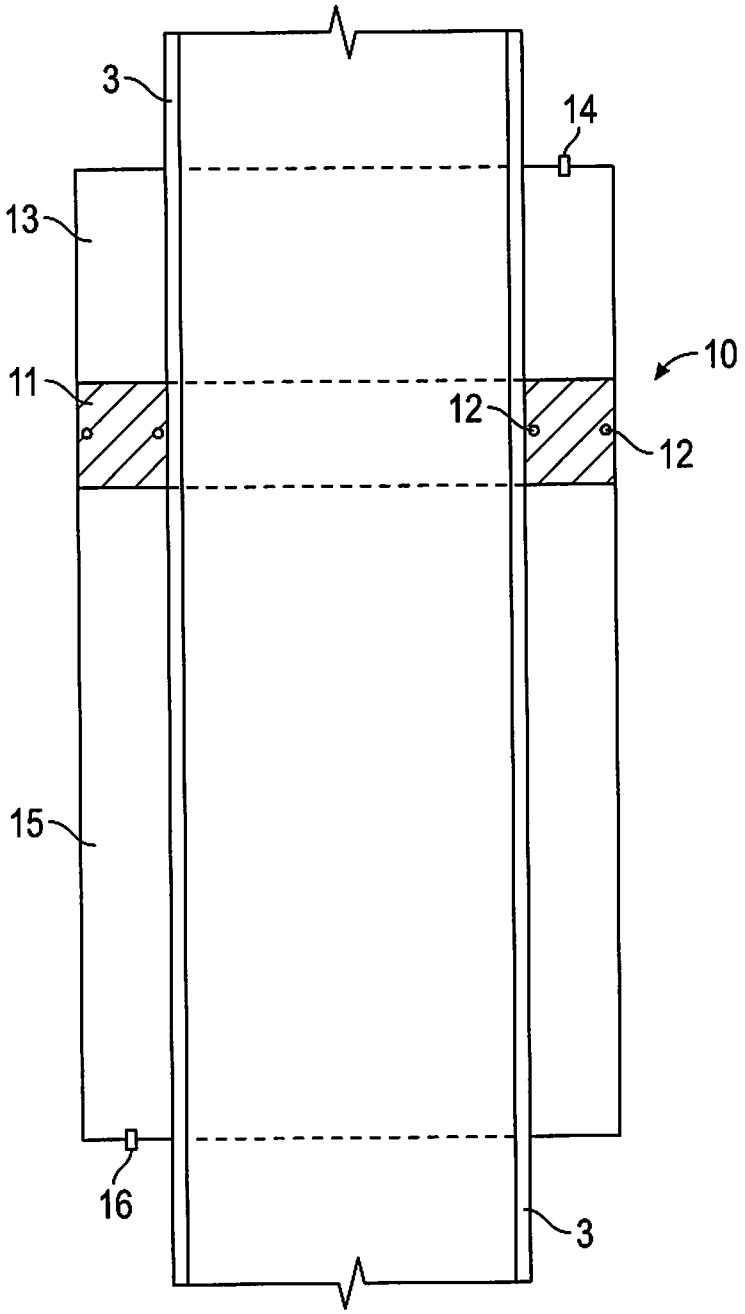
FIG. 4 illustrates one embodiment of an accumulator for the downhole tool.

The embodiment of FIG. 1 also includes an accumulator 10, which is shown in more detail in FIG. 4. This embodiment of accumulator 10 is formed by an annular pressure chamber mounted on casing 30. An internal annular piston 11 having seals 12 divides accumulator 10 between a gas chamber 13 and a hydraulic fluid chamber 15. A hydraulic outlet valve 16 provides for the transfer of hydraulic fluid from the accumulator 10 to sleeve valve 20's fluid supply valve 28. In certain embodiments, outlet valve 16 is a passive check valve allowing hydraulic fluid flow only out of hydraulic fluid chamber 15. However, in other embodiments valve 16 may be an electronically controlled (i.e., by a system controller) valve. It will be understood that gas pressure in chamber 13 acts on piston 11 in order to maintain pressure on hydraulic fluid in chamber 15. In certain embodiments, gas chamber 13 includes an inlet valve 14 (e.g., a passive check valve allowing inflow only) to allow re-supply of gas into chamber 13 to maintain a desired pressure level. Although gas chamber 13 could be re-supplied in any conventional or future developed manner, the FIG. 1 embodiment utilizes a solid to gas phase conversion derived from the igniting of a propellant located in re-charge chamber 8. The re-charge chamber 8 would contain expanding gases from the burning propellant and direct the gases to accumulator inlet valve 14. Re-charge chamber 8 may contain several discrete sections of propellant each may be selectively ignited at different times, thereby allowing re-charge of the gas chamber 13 repeatedly over long periods of time. As an alternative to re-charge chamber 8, other embodiments could have propellant charges positioned directly within the gas chamber of the accumulator. As a further alternative, certain embodiments could have a gas passage extending from the accumulator to the propellant charge section 40, thus allowing gases from the main stimulation propellant to recharge the accumulator. Non-limiting examples of acceptable propellants are the slow burning, lower order class of explosives.

In certain embodiments, hydraulic fluid released from sleeve relief valve 27 is simply discharged into the wellbore environment, i.e., no attempt is made to recover the hydraulic fluid. However, in other embodiments, a fluid path and re-pressurization system could be developed to direct hydraulic fluid back to accumulator 10 after the fluid discharges from relief valve 27.

The FIG. 1 embodiment of tool 1 also illustrates a propellant charge container or cartridge 40 positioned on casing 3. When ignited, the propellant in cartridge 40 will create a pressure wave which acts to stimulate the oil/gas containing formation around tool 1. In many embodiments, it is preferable that cartridge 40 be formed of a material that will maintain its integrity under normal wellbore conditions, but will disintegrate or rapidly degrade once the propellant material is ignited (or alternatively degrade over a designated time period). Non-limiting examples of such materials include carbon fiber composite materials, carbon fiber weave with energetic materials embedded therein, flammable epoxy compounds, or metals that will decompose under the heat and pressure of the ignited propellant (e.g., titanium, magnesium). Any number of propellants could be employed. As used herein, "propellant" means any energetic material, including high and low order explosives and deflagarants (i.e., substances which combust at a subsonic rate). Nonlimiting examples may include PETN, TNT, mixtures thereof, nitrates, perchlorates, mixtures thereof, explosives such as 3,3'-diamino-4,4'-azoxyfurazan (DAAF), and fire resistant, shock resistant insensitive high explosives (IHE) such as triaminotrinitrobenzene (TATB) or various insensitive explosive mixtures, or plastic/polymer-bonded explosives, which are similar to reactive materials. The construction and usage of propellant chamber 40 is described in greater detail in the above referenced U.S. Application Ser. No. 61/970,775, filed Mar. 26, 2014 and U.S. Pat. No. 8,127,832 issued Mar. 6, 2012, which is also incorporated by reference herein. FIG. 1 likewise illustrates a blank section 39 which provides a buffer space between valve 20 and the direct force resulting from the ignition of propellant cartridge 40. Obviously the length of blank section 39 is dependent on the force resulting from igniting the propellant and the robustness of valve 20. In embodiments where propellant cartridge 40 is employed, the force the propellant generates and its distance from valve 20 will be designed to break up and/or pulverize cement surrounding the valve, thereby allowing fluid communication between the valve and the surrounding formation.

Figure 2:
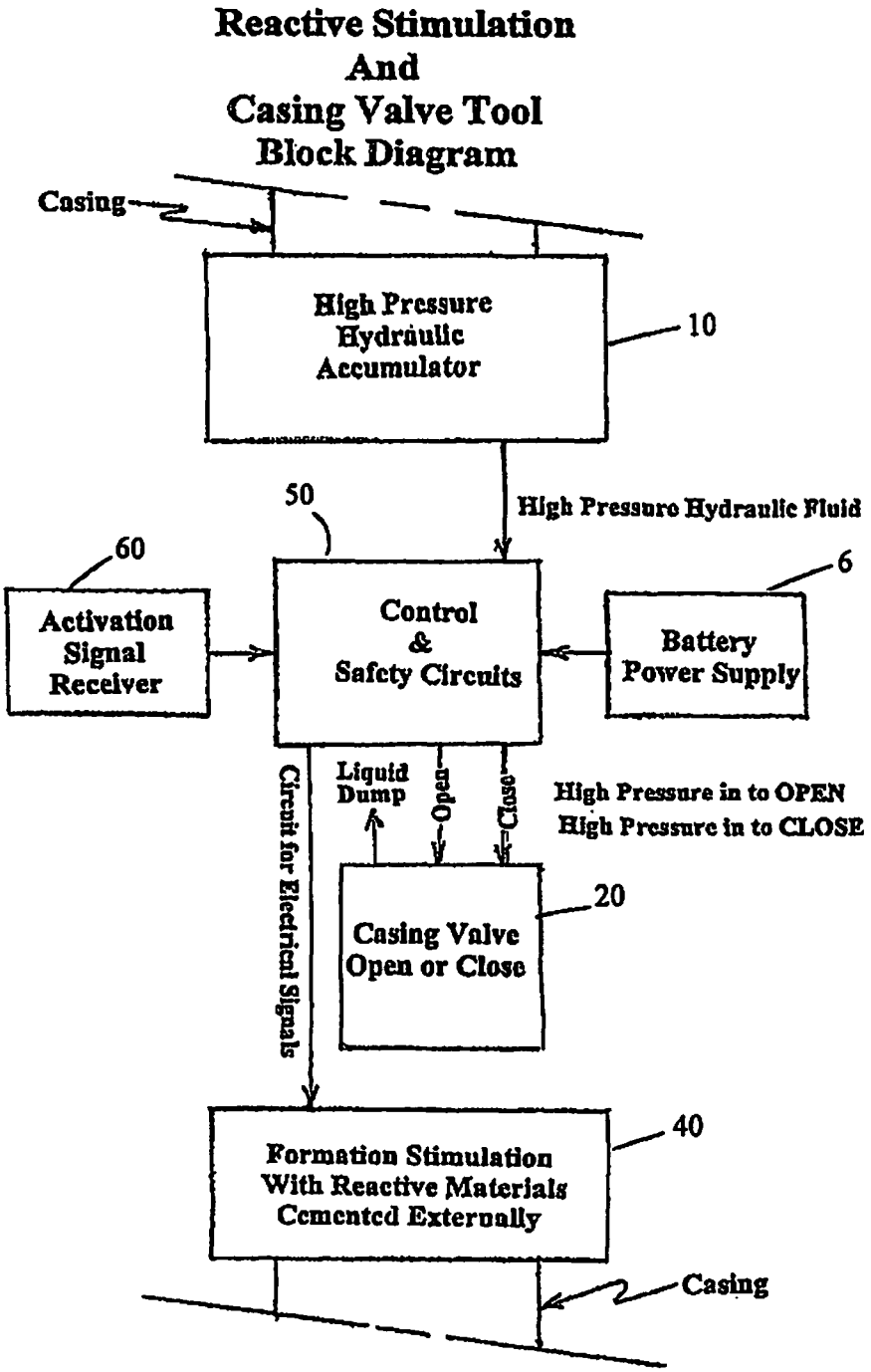
FIG. 2 is a block diagram of one embodiment of a control mechanism for the downhole tool.

In most embodiments of tool 1, the operation of various components described above will be regulated by some type of control system, such as the control (& safety) circuit 50 suggested in FIG. 2. Control circuit 50 (sometimes referred to as "controller" 50) will typically include a conventional microprocessor and the associated electronic components required to operate the tool 1 features as described herein. For example, control circuit 50 will provide instructions to open and close the fluid source valve 28 and the fluid relief valve 27 on sleeve valve 20. Control circuit 50 may also provide instructions initiating the ignition of propellant in gas re-charge chamber 8. Furthermore, control circuit 50 may provide the instructions to ignite (via any conventional ignition system) the propellant in propellant cartridge 40.

FIG. 2 also illustrates an activation signal receiver 60 allowing the control circuit 50 to receive commands to institute the various functions described above. In certain embodiments, the signal receiver may be a pressure transducer which is exposed to pressure in the wellbore environment at the location of tool 1. The pressure transducer may sense a series of low level pressure pulses applied at the surface to fluid in the well annulus or to the internal passage of tool 1. The pressure transducer coverts to pressure pulses to electrical signals which may be interpreted by the controller. The controller in turn activates electro-mechanical devices which are capable of opening various valves or operating other components described herein. One example of a system for converting pressure pulse into the actuation of valves is described in U.S. Pat. No. 4,796,699 issued Jul. 10, 1989 and which is incorporated by reference herein in its entirety. Although the signal receiver 60 described above is a pressure transducer, the system may include any other conventional or future developed signal receiver which is capable of detecting a coded signal, whether that signal is pressure based, electrical, sonic, radio frequency, or some other transmission means.

In the embodiment of FIG. 2, control circuit 50 would interface with a distinct safety circuit which in turn operates an explosive igniter. The initiation signal could originate externally and be received by an activation signal receiver. The received coded signal would be sent to the safety circuit which closes a safety switch and thereby allows an ignition instruction to ignite the propellant. The safety circuit could include a lock-out feature which shuts down the circuit if the coded activation signal is not received in a timely manner. This would prevent a series of inadvertent or environmental pulses over a long sequence from closing the safety switch. In many embodiments, such an activation signal could be of a geophysical nature such as sound waves, but it could be a series of pressure pulses or other detectable signals.

While FIGS. 3 and 4 illustrate one embodiment where the valve 20 is activated by fluid from an accumulator acting on a sleeve piston surface, this is merely one example of the many different valve actuation methods which could be employed in the current invention. FIG. 5 illustrates an alternative valve 20, electro-active polymer (EAP) valve 90. It will be understood that FIG. 5 shows the upper half of a tubular cross-section, with an outer tubular member 91 and an inner tubular member 92. In certain embodiments, inner tubular member 92 may correspond to casing 3. However, other embodiments may be constructed with the outer tubular member 91 correspondence to casing 3 (i.e., the tubular member acting as the sliding sleeve component is internal to the tool). It is only necessary that one tubular member be able to move relative to the other. In the FIG. 5 embodiment, outer tubular member 91 will include a series of apertures 98 and inner tubular member 92 will include a series of apertures 99. Likewise, a series of stop members 93A to 93C are connected to outer tubular member 91, while a series of stop members 94A and 94B are connected to inner tubular member 92. A series of seals 95 are positioned between tubular members 91 and 92, with the seals 95 allowing relative movement between the tubular members, but inhibiting fluid flow around the seals.

It can be seen in FIG. 5 how a first section of EAP material 97A is positioned between outer stop 93A and inner stop 94A. Likewise, a second section of EAP material 97B is positioned between outer stop 93C and inner stop 94B. Electrical leads 96 connect the EAP material sections 97 to an electrical power source such as batteries in the battery casing of FIG. 1. EAP material 97 may be any conventional or future developed EAP material capable of carrying out the valve functions described herein. EAPs may have several configurations, but are generally divided in two principal classes: Dielectric EAPs and Ionic EAPs. As one more specific family of compounds, Poly Vinylidene Fluoride (or PVDF) and its copolymers are widely used ferroelectric polymers. This may include Poly(vinylidene fluoride-trifluoro-ethylene), or P(VDF-TrFE), which is a PVDF polymer having been subject to electron radiation. P(VDF-TrFE) has displayed electrostrictive strain as high as 5% at lower frequency drive fields (150 V/mm).

Other EAPs may include Electrostrictive Graft Elastomers, which are polymers consisting of two components, a flexible macromolecule backbone and a grafted polymer that can be produced in a crystalline form. A typical example of a dielectric EAP is a combination of an electrostrictive-grafted elastomer with a piezoelectric poly(vinylidene fluoride-trifluoro-ethylene) copolymer.

Likewise, Electro-Viscoelastic Elastomers are composites of silicone elastomer and a polar phase. Upon curing, an electric field is applied that orientates the polar phase within the elastomeric matrix. Liquid Crystal Elastomer (LCE) Materials exhibit EAP characteristics by inducing Joule heating. LCEs are composite materials consisting of monodomain nematic liquid crystal elastomers and conductive polymers which are distributed within their network structure.

Alternative activation mechanisms may include Ionic Polymer Gels, including polyacrylonitrile materials which are activated by chemical reaction(s), a change from an acid to an alkaline environment inducing an actuation through the gel becoming dense or swollen. Ionomeric Polymer-Metal Composites (IPMC) can be another alternative and typically can bend in response to an electrical activation as a result of the mobility of cations in the polymer network.

In operation, FIG. 5 suggests the application of electrical power to EAP material section 97B, causing the expansion of this section of EAP material. Acting between stops 94B and 93C, the expanding EAP material tends to move outer aperture 98 to the right of inner aperture 99. With a seal 95 between the two apertures, the valve is closed, i.e., no fluid path exists between the inner passage of the valve and the wellbore annulus. Similarly, it can be envisioned how removing power from EAP material section 97B and applying power to EAP material section 97A will tend to move outer tubular member 91 to the left relative to inner tubular member 92, thereby aligning the apertures 98 and 99 and opening a fluid path to the wellbore annulus.

FIG. 6 illustrates another valve embodiment, shaped memory alloy (SMA) activated valve 105. Like the EAP activated valve 90, SMA activated valve 105 includes outer tubular member 91 with valve apertures 98 and inner tubular member 92 with valve apertures 99. Outer tubular member 91 includes the wire anchor 110 and inner tubular member 92 includes wire anchor 108. The SMA wire 107 extends between and is connected to anchors 110 and 108. A closing spring 109 extends between wire anchor 110 and a raised shoulder section 111 formed on inner tubular member 92 (with SMA wire 107 extending through an aperture in shoulder section 111). SMA wire 107 extends through a wire gripper 75 and seals 106 are positioned between tubular members 91 and 92. The section A-A illustrates how a series of SMA wires 107 (and by implication wire grippers 75) are positioned around the circumference of inner tubular member 92.

Any number of SMA materials may be used in constructing wires 107. The two main types of SMAs are copper-aluminium-nickel, and nickel-titanium (NiTi) alloys, but SMAs can also be created by alloying zinc, copper, gold and iron. Although iron-based and copper-based SMAs, such as Fe—Mn—Si, Cu—Zn—Al and Cu—Al—Ni, are commercially available and less expensive than NiTi. NiTi based SMAs are often more preferable for most applications due to their stability, practicability and superior thermo-mechanic performance. SMA actuators are typically actuated electrically, where an electric current results in Joule heating. Deactivation typically occurs by free convective heat transfer to the ambient environment.

Figure 8:
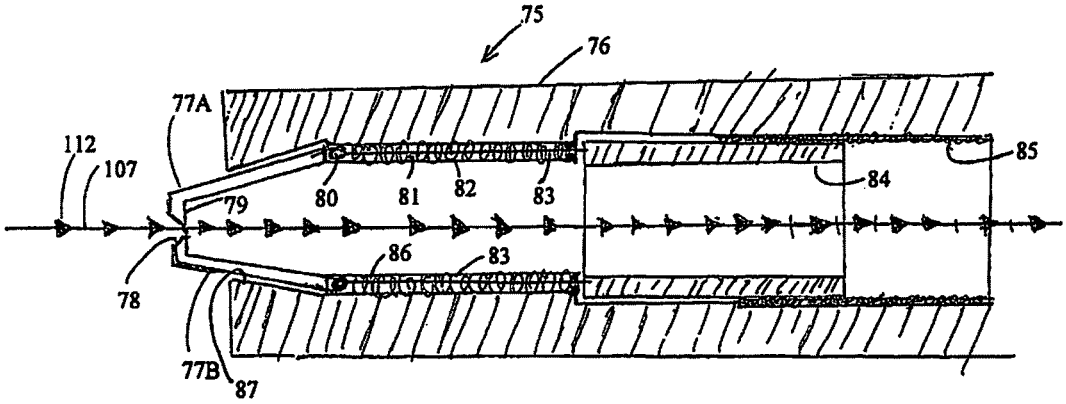
FIG. 8 illustrates a wire gripping mechanism for one embodiment of the downhole tool.

FIG. 8 illustrates one embodiment of a wire gripper 75. Wire gripper 75 generally includes the gripper housing 76 which is shown attached to inner tubular member 92 in the FIG. 5 embodiment. The forward section of gripper housing 76 includes the inclined guide walls 87 which function to urge jaw members 77A and 77B together as explained in more detail below. The jaw members 77A and 77B have at one end the outer inclined surfaces 78 and the inner vertical surfaces 79. The other end of jaw members 77A and 77B will be attached to pin 80 which is capable of traversing longitudinally in the pin slots 81 formed in gripper housing 76. Although the cross-section of FIG. 8 shows two jaw members 77, it will be understood that additional jaw members 77 could be positioned in gripper housing 76 such that the jaws surround SMA wire 107 and form a cone or pyramid shape when in the closed position. As discussed, the pins 80 on jaw members 77 will ride within pin slots 81. It may be envisioned how the movement of jaw members 77 rearward in pin slots 81 and away from guide walls 87 will allow the forward ends of the jaw members to part relative to SMA wire 107. The return springs 82 are positioned in pins slots 81 and operate to urge the jaw members 77 forward against the guide walls 87 (i.e., urge the jaws into their closed, gripping position). Release wires 86 (or alternatively release rods) connect on one end to pins 80, extend through the return springs 82, and connect on the other end to magnetized plunger 84. Magnetize plunger 84 takes on the cross-sectional shape of the internal bore of gripper housing 76 such that plunger 84 may move forward and rearward within the internal bore. Positioned to the rear of, and in a gap between the internal bore wall and plunger 84, are the coil windings 85, which are fixed in position along the surface of the internal bore. It will be understood that magnetized plunger 84 and coil windings 85 form a solenoid type device whereby energizing of coil windings 85 pulls magnetized plunger 84 rearward within the housing internal bore.

With the above described structure, the operation of wire gripper 75 will be apparent. In the FIG. 8 embodiment, the SMA wire 107 includes a series of arrow-head shaped barbs 112 and extends through the internal bore of gripper 75. As the wire 107 pulls through gripper 75 (from left to right), the inclined surface of barbs 112 will encounter the inclined front surface of jaw member 77. Force exerted by barbs 112 on jaw members 75 will compress return spring 82, push jaw members 77 rearward, and allow the jaw members to separate sufficiently to cause the barb 112 to pass between the jaw members. Thereafter, return spring 82 will urge jaw member 77 forward against guide walls 87, causing the jaw members to close again. This mechanism will be repeated as successive barbs 112 are pulled into engagement with jaw members 77. When the wire 107 attempts to move in the opposite direction (from right to left in FIG. 8), the rear vertical surface of barbs 112 encounter the vertical surface 79 of jaw members 77. This direction of force will tend to draw jaw members 77 against guide walls 87 and cause the jaw members to more tightly engage wire 107.

When it is desired to draw jaw members 77 apart in order to release wire 107 (i.e., without actively pulling wire 107 through gripper 75), the coil windings 85 will be energized in order to move plunger 84 rearward. This in turn exerts a rearward force on release wires 86 and jaw pins 80, thereby pulling jaw members 77 rearward as the force of return springs 82 is overcome, and ultimately allowing jaw members 77 to separate. When coil windings 85 cease to be energized, return springs 82 will again urge jaw members 77 forward.

Returning to FIG. 6, it may be envisioned how selectively energizing the various SMA wires 107 in valve 105 will supply the force needed to overcome spring 109 and align the apertures 98 and 99. Viewing section A-A, two (or four) opposing SMA wires 107 are energized in a series of steps. The energized SMA wires 107 will contract, urging the wire anchors 108 and 110 on the inner and outer tubular members closer together. As wire grippers 75 are fixed to inner tubular member 92, all the wire grippers 75 (whether or not associated with energized wires) will move forward on their respective SMA wires 107. When wires 107 cease to be energized, wire grippers 75 engage wire 107 and prevent closing spring 109 from returning the inner and outer tubular members to their initial relative positions. Next, an alternate set of SMA wires 107 are energized, thus further urging relative movement of the inner and outer tubular members and the progressive movement of grippers 75 along the wires 107. It can be seen how this iterative movement of the grippers along wires 107 eventually moves apertures 98 and 99 into alignment and thus opens the valve 105. The controller (see FIG. 2) may be programmed to selectively energize different sets of SMA wires 107 in order to perform this valve opening sequence. To reclose the valve, the solenoid release mechanism in grippers 75 is activated, allowing the grippers to release wires 107 and closing spring 109 to move the apertures 98 and 99 out of alignment.

Figure 7:
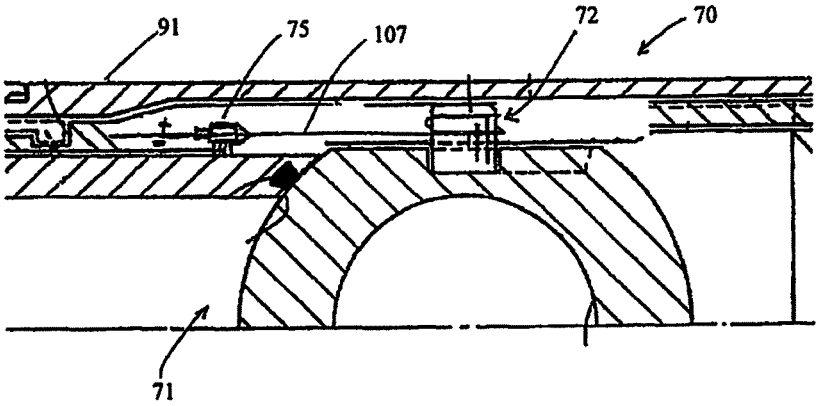
FIG. 7 illustrates a ball valve for one embodiment of the downhole tool.

FIG. 7 suggests a further alternative valve system. FIG. 7 is a half-section view illustrating a ball 71 positioned in ball valve 70. The ball 71 is shown in the closed position, i.e., the center aperture of the ball 71 is unaligned with central passage of the valve's tubular housing. The ball valve is opened by applying torque to the valve stem 72 which rotates the center aperture of ball 71 into alignment with the central passage of the valve housing. In the FIG. 7 embodiment, torque is applied to valve stem 72 by having the SMA wire 107 be affixed to and coiled around valve stem 72, with preferred embodiments having SMA wire 107 making several turns around valve stem 72. Upon energizing SMA wire 107, the wire contracts and applies the torque to stem 72 necessary to rotate the ball 71 to the open position. In certain embodiments, a wire gripper 75 such as described above may be utilized to apply tension to SMA wire 107 in multiply step. However, if the SMA wire 107 constricts sufficiently with one application of electrical current, a wire gripper 75 may not be necessary. Although not shown in the drawings, it will be understood that the ball may be rotated back to the closed position by arranging an opposing section of SMA wire to apply torque in the direction opposite that suggested in FIG. 8.

As used herein, "SMA wire" means any elongated section of SMA material, regardless of thickness or cross-section and could include for example, "rods" of SMA material. Although many embodiments utilize an SMA wire which contracts upon electrification, mechanical arrangements may be implemented using SMA materials which expand or bend upon electrification. "Electro-active material" means any material (solid or fluid) which changes shape or volume when subject to a change in voltage or current, including but not limited to EAP materials and SMA materials. Likewise, the valve actuation mechanism may include any structure used to open or close a valve. For example, in FIG. 3, the valve actuation mechanism includes the piston surfaces and the fluid supply/pressure relief valves. In certain embodiments, a valve actuation mechanism may include an accumulator, in other embodiments it may not. The EAP materials or SMA materials acting against stops or anchors are another example of valve actuation mechanisms.

It will be understood that many embodiments are actuated via a controller activating hydraulic valves, EAP valves, etc. are opening and closing the valve without the intervention of a tethered activation tool; e.g., a tool lowered from the surface on coil tubing or wireline which has a profile for mechanically opening the valve.

Although many embodiments are shown as having a local power source such as batteries, other embodiments could utilize power carried by conductors running from the surface. Likewise, certain embodiments disclose the controller receiving coded signals (generally wireless) via a signal receiver. However, the controller could also carry out instructions based on date/time or sensing certain wellbore conditions, e.g., pressure, temperature, pH, etc. Additionally, the controller could receive signals through a communication wire/cable running to the surface.

Although the above described figures disclose certain specific embodiments of the present invention, all obvious variations and modifications of the illustrated embodiments should be considered as following within the scope of the present invention.

The invention claimed is:

1. A downhole completion tool comprising:

a. a main tool housing defining an internal channel from an external flow area;

b. a valve allowing selective communication between the internal channel and the external flow areas;

c. a valve actuation mechanism allowing opening of the valve without intervention of a tethered activation tool, the actuation mechanism including a hydraulic accumulator on the tool housing, the accumulator (i) including a reservoir of hydraulic fluid, and (ii) being in communication with a pressurized gas source transmitting pressure to the hydraulic fluid; and d. a propellant-containing cartridge formed on the outside of the tool housing.

2. The downhole completion tool according to claim 1, wherein the external flow area is a wellbore annulus surrounding the main tool housing.

3. The downhole completion tool according to claim 1, wherein the main tool housing includes at least one casing section and the valve includes a sleeve positioned external to the casing section.

4. The downhole completion tool according to claim 3, wherein (i) the sleeve includes first and second piston surfaces, and (ii) a fluid supply valve selectively directs fluid to the first or second piston surfaces.

5. The downhole completion tool according to claim 1, further comprising a controller and a signal receiver, wherein the controller operates the valve actuation mechanism.

6. The downhole completion tool according to claim 1, wherein the propellant-containing cartridge includes sufficient propellant to, upon ignition, create a pressure wave acting to stimulate an oil/gas containing formation around the tool housing.

7. The downhole completion tool according to claim 1, wherein ignition of a propellant in the propellant containing cartridge supplies pressurized gas to the accumulator.

8. The downhole completion tool according to claim 7, wherein the valve actuation mechanism includes a controller and a signal receiver.

9. The downhole completion tool according to claim 8, wherein the signal receiver is capable of detecting at least one of fluid pressure pulses or acoustic signals.

10. The downhole completion tool according to claim 9, wherein the controller, upon receipt of distinct codes from the signal receiver, operates to ignite the propellant and/or activate the valve actuation mechanism.

11. A downhole completion tool comprising:

a. a tool housing defining an internal channel from a wellbore annulus;

b. a valve allowing selective communication between the internal channel and the wellbore annulus, the valve comprising a sliding sleeve positioned externally to the tool housing;

c. a hydraulic accumulator external to the tool housing, the accumulator (i) including a reservoir of hydraulic fluid, and (ii) being in communication with a pressurized gas source transmitting pressure to the hydraulic fluid, thereby providing a stored force for moving the sliding sleeve;

d. a valve actuation mechanism selectively releasing the stored force of the accumulator without intervention of a tethered activation tool; and e. a propellant-containing cartridge formed on the outside of the tool housing.

12. The downhole completion tool according to claim 11, wherein the tool housing includes at least one casing section and the valve includes a sleeve positioned external to the casing section.

13. The downhole completion tool according to claim 11, wherein the valve actuation mechanism includes a controller and a signal receiver.

14. The downhole completion tool according to claim 13, wherein the signal receiver is capable of detecting at least one of fluid pressure pulses or acoustic signals.

15. The downhole completion tool according to claim 14, wherein the controller, upon receipt of distinct codes from the signal receiver, operates to ignite the propellant or activate the valve actuation mechanism.

16. The downhole completion tool according to claim 13, further comprising the sliding sleeve connected to a first piston surface for opening the valve and a second piston surface for closing the valve, wherein the controller activates a fluid inlet valve for delivering fluid to the piston surfaces.

17. The downhole completion tool according to claim 16, wherein the controller actuates a fluid relief valve for releasing hydraulic pressure on the piston surfaces.

18. The downhole completion tool according to claim 11, wherein the sliding sleeve is connected to a first piston surface for opening the valve and a second piston surface for closing the valve.

19. The downhole completion tool according to claim 11, wherein ignition of a propellant charge supplies pressurized gas to the accumulator.

20. The downhole completion tool according to claim 11, wherein the propellant-containing cartridge is formed of a polymer material.

21. The downhole completion tool according to claim 11, wherein a recharging chamber includes a plurality of propellant sections and a controller is capable of selectively activating each of the plurality of propellant sections.

22. A casing valve comprising:

a. a tool housing defining an internal channel from a wellbore annulus;

b. a sleeve valve allowing selective communication between the internal channel and the wellbore annulus, the sleeve valve comprising a sliding sleeve positioned externally to the tool housing;

c. a first piston surface for opening the sleeve valve and a second piston surface for closing the sleeve valve attached to the sleeve;

d. a fluid supply valve directing fluid to the first and second piston surface;

e. an accumulator providing pressurized fluid to the fluid supply valve;

f. an electronic controller operating the fluid supply valve to selectively direct the fluid to the first or second piston surface; and g. a propellant re-charge cartridge containing propellant ignited by the controller and directing gas from the ignited propellant to the accumulator.

* * * * *